United States Patent [19]

Masubuchi

[11] 4,363,185

[45] Dec. 14, 1982

[54] VEHICLE WITH GEAR-CHANGING MECHANISM INCLUDING TWO DISPLACEABLE GEARS

[75] Inventor: Hiroshi Masubuchi, Utsunomiya, Japan

[73] Assignee: Tonka Corporation, Minneapolis, Minn.

[21] Appl. No.: 218,296

[22] Filed: Dec. 19, 1980

Related U.S. Application Data

[62] Division of Ser. No. 942,428, Sep. 14, 1978.

[30] Foreign Application Priority Data

Oct. 14, 1977 [JP] Japan ..... 52-138565[U]

[51] Int. Cl.[3] ..... A63H 17/00; A63H 29/20

[52] U.S. Cl. ..... 46/209; 74/329

[58] Field of Search ..... 74/61, 325, 329, 331, 74/384; 46/202, 206, 208, 209, 201

[56] References Cited

U.S. PATENT DOCUMENTS

| | | | |
|---|---|---|---|
| 806,977 | 12/1905 | Kingsbury | 46/209 |
| 3,546,809 | 12/1970 | Nielson | 46/206 |
| 3,798,831 | 3/1974 | Hagashi | 46/206 |
| 3,812,933 | 5/1974 | Darda | 185/37 |
| 4,059,918 | 11/1977 | Matsushiro | 46/209 |
| 4,077,156 | 3/1978 | Asano | 46/206 |
| 4,116,084 | 9/1978 | Masuda | 46/209 X |
| 4,130,963 | 12/1978 | Ohashi | 46/209 |
| 4,141,256 | 2/1979 | Wilson et al. | 46/209 X |
| 4,283,879 | 8/1981 | Tsui | 46/209 |

FOREIGN PATENT DOCUMENTS

| | | | |
|---|---|---|---|
| 960859 | of 0000 | Canada | 46/206 |
| 2363347 | 5/1978 | France | 46/206 |
| 470479 | 8/1937 | United Kingdom | 46/206 |

*Primary Examiner*—F. Barry Shay

*Attorney, Agent, or Firm*—Merchant, Gould, Smith, Edell, Welter & Schmidt

[57] ABSTRACT

A toy vehicle is disclosed including a gear changing mechanism for use in conjunction with a flywheel driving device. The mechanism comprises a gear changing lever pivotally mounted to a frame by means of a pin. The lever is biased in one direction by means of a first spring member to hold the axle of an idle gear in engagement with one end of an elongated opening formed in the frame. The gear changing lever is adapted to pivot by a depressing action against the force of the first spring member to disengage the idle gear axle from the one end of the elongated opening so as to allow a second spring member to urge the idle gear axle against the other end of the elongated opening.

10 Claims, 3 Drawing Figures

FIG. 1
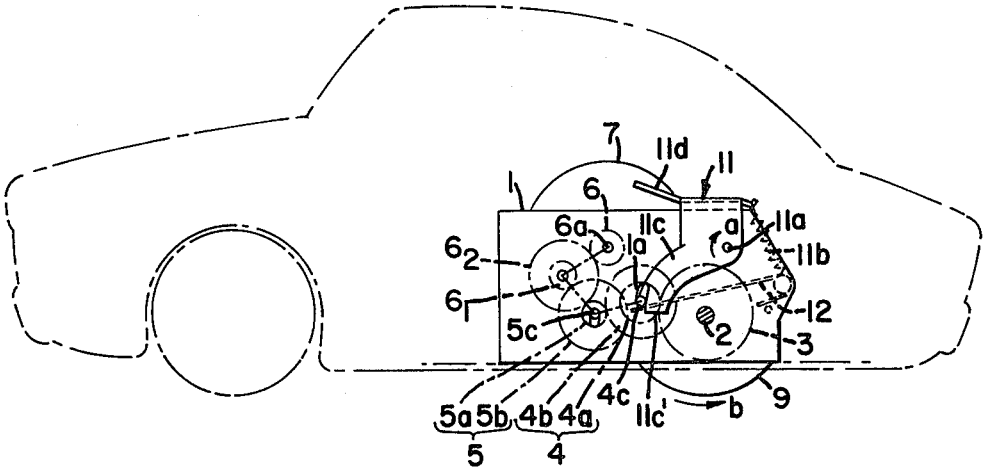
FIG. 2
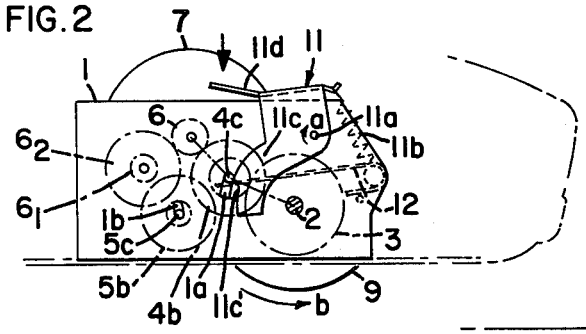
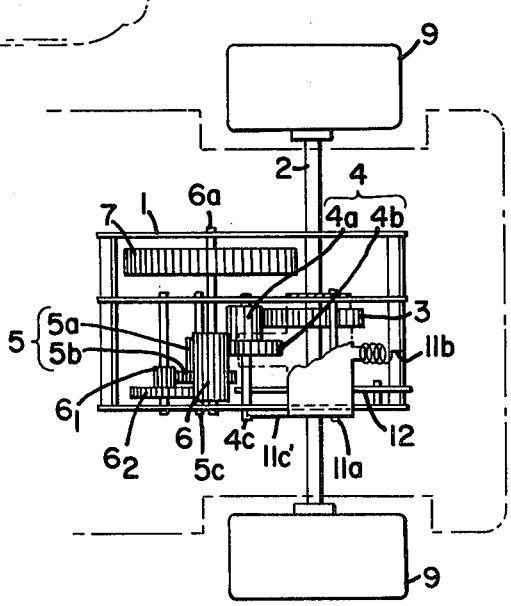
FIG. 3

VEHICLE WITH GEAR-CHANGING MECHANISM INCLUDING TWO DISPLACEABLE GEARS

This is a division of application Ser. No. 942,428, filed Sept. 14, 1978.

BACKGROUND OF THE INVENTION

The present invention relates to a built-in power source or flywheel driving device for use in toy vehicles such as trains and cars and, more particularly, to a gear changing mechanism for use in such a driving device.

The present invention provides a gear changing mechanism in which gear changing can be effected simply by depressing a lever.

IN THE DRAWINGS

FIG. 1 is a side view showing the present invention before the gear changing lever is depressed;

FIG. 2 is a side view after the gear changing lever is depressed; and

FIG. 3 is a plan view of the present invention.

DETAILED DESCRIPTION OF THE PRESENT INVENTION

One embodiment of a gear changing mechanism made in accordance with the present invention will now be described in detail with reference to the accompanying drawings. The built-in flywheel driving device is first described. The gear changing mechanism of the present invention is then described. In the figures, the reference numeral 1 designates the frame of the driving device or power source. An axle 2 is rotatably mounted in the frame 1. The axle 2 has wheels 9 on its opposite ends. A toothed wheel 3 is secured on the axle 2. A first idler gear 4 is secured on its axle 4*c*. The axle 4*c* is supported in elongated holes 1*a* formed in the frame 1. The first idler gear 4 includes small and large diameter toothed wheels 4*a* and 4*b*. The small diameter toothed wheel 4*a* is held in mesh with the toothed wheel 3. A second idler gear 5 is secured on its axle 5*c* which is received in elongated holes 1*b* formed in the frame 1. Elongated holes 1*b* as shown in FIGS. 1 and 2 are arcuate slots. The second idler gear 5 includes small and large diameter toothed wheels 5*a* and 5*b*. The small diameter toothed wheel 5*a* meshes with the large diameter toothed wheel 4*b* of the first idler gear 4 when the axle 4*c* of the first idler gear 4 is held in engagement with the lower end of the elongated hole 1*a* and comes out of mesh with the large diameter toothed wheel 4*b* when the axle 4*c* of the first idler gear 4 is urged against the upper end (the other end) of the elongated hole 1*a*. A gear 6 is drivingly connected through toothed wheels $6_1$ and $6_2$ to the large diameter toothed wheel 5*b* of the second idler gear 5. The gear 6 directly meshes with the large diameter toothed wheel 4*b* of the first idler gear 4 when the axle 4*c* of the idler gear 4 is urged to the upper end of the elongated hole 1*a* formed in the frame 1. A flywheel 7 is secured on the axle 6*a*.

Explanation is next made of the gear changing mechanism in accordance with the present invention. A gear changing lever 11 is pivotally mounted to the frame 1 by a pin 11*a*. The gear lever 11 has a stopper portion 11*c* formed in its lower end with a groove 11*c*', and an operating portion 11*d*. A spring member 11*b* biases the lever 11 in the direction indicated by the arrow a to place the stopper portion 11*c* in the position of holding the axle 4*c* of the first idler gear 4 in the lower end of the elongated hole 1*a* which as shown in FIGS. 1 and 2 is an arcuate slot. Depressing of the operating portion 11*d* causes the lever 11 to rotate against the force of the spring member 11*b* in the direction opposite to the arrow a direction, whereby the groove 11*c* is disengaged from the axle 4*c*. A spring member 12 biases the axle 4*c* of the idler gear 4 toward the upper end of the elongated hole 1*a*.

The operation of the gear changing mechanism of the present invention will now be described. When the wheels 9 are rotated in the direction of the arrow b such as by rubbing them against the floor gear 3 rotatably acts on gear 4 and thereby, the axle 4*c* of the first idler gear 4 is urged against the lower end of the elongated hole 1*a* and locked there by the stopper portion 11*c* with its groove 11*c* fitting on the axle 4*c*. The rotation of the wheels 9 is transmitted through gear 4 to the second idler gear 5 to lift gear 5 into rotating engagement with the gears $6_1$ and $6_2$ to the gear 6 so as to rotate the flywheel 7 at a high speed. Thereafter, the axle 5*c* of the idler gear 5 falls down by its weight on the lower end of the elongated holes 1*b* so that the connection between the gear 5 and the gear $6_1$ is released. Thus the rotation of wheels 9 and gear 3 serves as shifting mechanism to shift the idler gear 4 to the position of FIG. 1. The rotation of wheels 9, gear 3 and gear 4 serves as shifting mechanism to lift gear 5 into driving engagement with gear $6_1$. After the rotation of the wheels 9 stops, the operating portion 11*d* is depressed to rotate the gear changing lever 11 in the direction opposite to the arrow a direction and against the force of the spring member 11*b*, whereby the groove 11*c* comes out of engagement from the axle 4*c*. The axle 4*c* is pushed against the upper end of the elongated holes 1*a* by the force of the spring member 12. The gear 6 meshes with the idler gear 4 so that rotation of the flywheel is transmitted to the wheels 9 thereby driving them at a high speed.

As described above, the present invention provides a gear changing mechanism for use in a built-in flywheel driving device. The mechanism comprises a gear changing lever 11 pivotally mounted to a frame 1 by means of a pin 11*a* and biased in one direction by means of a first spring member 11*b* to hold the axle 4*c* of an idler gear 4 in engagement with one end of an elongated hole 1*a* formed in the frame 1. The gear changing lever 11 is adapted to rotate by a depressing action against the force of the first spring member 11*b* to disengage the idler gear axle 4*c* from the one end of the elongated hole 1*a* so as to allow a second spring member 12 to urge the idler gear axle 4*c* against the other end of the elongated hole 1*a*. In this arrangement, the toy vehicle can be started or speed-changed by depressing of the operating portion of the gear changing lever to change the gear. That is, depressing of the operating portion of the gear changing lever will cause the wheels held stopped to start rotating (in case the idler gear 5 is used as described in the illustrated embodiment), or the wheels rotating at a low speed to rotate at a high speed (in case a normal gear is used in place of the idler gear 5).

What is claimed is:

1. A toy vehicle comprising a body supported on a plurality of wheels, said body including a power source, said power source comprising a flywheel secured on an axle; gear means interconnecting said flywheel to said toy vehicle wheels, said gear means including gears engageable in a first gear path to interconnect said flywheel to said wheels when said vehicle is moved in one direction and gears engageable in a second gear path to interconnect said flywheel to said wheels when said flywheel drives said wheels; said gear means including shifting means for changing said gear means from one path to the other path, said shifting means including a radially displaceable idler gear, said idler gear being shiftable from a position of nonengagement in said first gear path to a position of engagement in said first gear path, said idler gear being radially displaceable from a position of engagement in said first gear path to a position of non-engagement in said first gear path, said idler gear being radially displaceable from a position of non-engagement in said second gear path to a position of engagement in said second gear path and said idler gear being radially displaceable from a position of engagement in said second gear path to a position of non-engagement in said second gear path, said shifting means further including a second radially displaceable idler gear, said first idler gear being rotatable independent of said second idler gear when engaged in said second gear path, and said second idler gear being engageable in said first gear path by the driving action of said first-mentioned idler gear when said first idler gear is being driven by said wheels.

2. The toy vehicle of claim 1 wherein said shifting means comprise a gear changing lever.

3. The toy vehicle of claim 1 wherein said second idler gear is disengaged by gravity whenever said first idler gear is not being driven.

4. The toy vehicle of claim 3 wherein said shifting means include a gear changing lever, said lever shifts said first idler gear from said non-engaged second path position to engagement in said second gear path thereby being adapted to drive said wheels.

5. A toy vehicle comprising a vehicle body supported on a plurality of wheels, said body including a power source for driving certain of said wheels of the toy vehicle, said power source including a flywheel and gear means, said gear means including gears engageable in a first gear path and gears engageable in a second gear path, said gears in said first gear path providing a driving relationship between said wheels and said flywheel in one mode of operation and said gears in said second gear path being capable of providing a driving relationship between said flywheel and said wheels in another mode of operation;

said gears including:

a first gear and axle combination, said axle being rotatably locked with respect to said wheels;

a second gear and axle combination, said axle being rotatably supported in a first pair of arcuate slot supports, said second gear and axle combination being movable in said slot supports from a first operating position for function in said one mode of operation to a second operating position for function in said other mode of operation;

shifting means for moving said second gear and axle combination from said first operating position to said second operating position and from said second operating position to said first operating position; and a third gear and axle combination, said third gear and axle combination being rotatably supported in a second pair of arcuate slot supports, said third gear and axle combination being moveable in said slot supports from a first neutral position to a second operative position, and wherein said third gear in the second position provides a driving relationship between said wheels and said flywheel whereby said wheels may rotatably drive said flywheel, said third gear and axle combination being lifted into said second operative position by the increasing rotational force of said second gear and axle combination and falling into the neutral position when said second gear and axle combination is not imparting increasing rotational force to said third gear and axle combination.

6. The toy vehicle of claim 5 wherein said shifting means comprise lever means for releasably holding said second gear and axle combination into said first operating position and wherein said shifting means further includes means for releasably biasing said second gear and axle combination into said second operating position.

7. The toy vehicle of claim 5 wherein said shifting means comprise means for releasably holding said second gear and axle combination into said first operating position and wherein said shifting means further includes second means for releasably biasing said second gear and axle combination in said second operating position.

8. The toy vehicle comprising a body, a power source carried by said body, and wheel means for supporting said body, said power source comprising:

a flywheel mounted on a shaft;

gear means adapted for interconnecting said flywheel and said wheel means, said gear means comprising a plurality of gears adapted to form a first gear path to interconnect said flywheel to said wheel means at a first gear ratio when said vehicle is manually moved along a surface and said plurality of gears being adapted to form a second gear path at a second gear ratio when said flywheel drives said wheel means; and shifting means for changing said gears from operation in said first gear path to operation in said second gear path, said shifting means including a first idler gear and shaft combination, said first idler gear shaft being disposed in a first pair of slot supports, said first idler gear and shaft combination being radially displaceable along said first slot supports, said first idler gear thereby being displaceable from a neutral position to a position of engagement in said one gear path and from the position of engagement in said first gear path to a neutral position, said first idler gear further being displaceable from a neutral position to a position of engagement in said second gear path and from the position of engagement in said second gear path to a neutral position, said shifting means further including a second idler gear and shaft combination, said second idler gear shaft being disposed in a second pair of slot supports for radial displacement along said second slot supports into and out of engagement in said second gear path, said latter radial displacement into engagement being effected by rotatable action of said first idler gear on said second idler gear when said first idler gear is being driven while in the position for engagement in said first gear path.

9. The toy vehicle of claim 8 wherein said shifting means includes spring means for urging said first idler gear into engagement in said first gear path and second spring means for urging said first idler gear into engagement in said second gear path.

10. A toy vehicle comprising a vehicle body supported on a plurality of wheels, said body including a power source for driving certain of said wheels, said power source including a flywheel and gear means, said gear means including a first gear path and a second gear path, said first gear path providing a driving relationship between said wheels and said flywheel in one mode of operation and said second gear path being capable of providing a driving relationship between said flywheel and said wheels in another mode of operation;

said gear means including:

a first gear and axle combination, said axle being rotatably locked with respect to said driven wheels;

a second gear and axle combination, said axle being rotatably supported in a first pair of arcuate slots, said second gear and axle combination being movable in said first slots from a first operating position for function in said one mode of operation to a second operating position for function in said other mode of operation, means for releasably holding said second gear in said first operating position and spring means for urging said second gear into said second operating position;

shifting means for moving said second gear and axle combination from said first operating position to said second operating position and from said second operating position to said first operating position; and a third gear and axle combination, said third gear and axle combination being rotatably supported in a second pair of arcuate slots, said third gear and axle combination being movable in said slots from a first neutral position to a second operative position, and wherein said third gear in the second position provides a driving relationship between said wheels and said flywheel whereby said wheels may rotatably drive said flywheel, said third gear and axle combination being lifted into said second operative position by the increasing rotational force of said second gear and axle combination and falling by gravitational force into the neutral position when said second gear and axle combination is not imparting increasing rotational force.

* * * * *